US010933341B1

(12) United States Patent
Billeter

(10) Patent No.: US 10,933,341 B1
(45) Date of Patent: Mar. 2, 2021

(54) TOY FORMED OF TOOLS

(71) Applicant: Don M. Billeter, Grand Prairie, TX (US)

(72) Inventor: Don M. Billeter, Grand Prairie, TX (US)

( * ) Notice: Subject to any disclaimer, the term of this patent is extended or adjusted under 35 U.S.C. 154(b) by 22 days.

(21) Appl. No.: 15/370,853

(22) Filed: Dec. 6, 2016

(51) Int. Cl.
*A63H 17/00* (2006.01)
*A63H 17/26* (2006.01)
*A63H 33/00* (2006.01)
*A63H 33/10* (2006.01)

(52) U.S. Cl.
CPC ..... *A63H 17/002* (2013.01); *A63H 17/262* (2013.01); *A63H 33/003* (2013.01); *A63H 33/107* (2013.01)

(58) Field of Classification Search
CPC .. A63H 33/003; A63H 33/107; A63H 17/002; A63H 17/262
USPC .... 446/75, 76, 77, 78, 86, 93, 95, 469, 470, 446/471
See application file for complete search history.

(56) References Cited

U.S. PATENT DOCUMENTS 2,516,537 A * 7/1950 Wetzel ..... A63H 17/262 279/51
2,768,834 A * 10/1956 Wilson ..... A63H 33/107 280/259
3,528,193 A * 9/1970 Yamakawa ..... A63H 17/002 446/424
3,939,600 A 2/1976 Eid
4,120,118 A * 10/1978 Mathews ..... A63H 17/002 434/219
4,299,051 A 10/1981 Pauly et al.
4,435,916 A 3/1984 Iwao et al.
4,551,109 A * 11/1985 Hanson ..... A63H 17/00 446/465
4,581,793 A * 4/1986 Micklitz ..... A63H 33/102 24/297
4,753,346 A * 6/1988 Tsuji ..... A45C 11/36 206/224
4,807,802 A * 2/1989 Williams ..... B65D 81/365 217/12 R
5,078,641 A * 1/1992 Chen ..... A63H 17/002 446/145
5,083,969 A * 1/1992 Wagener ..... A63H 17/26 446/470
5,454,746 A * 10/1995 Guegan ..... A63H 3/003 446/268
5,498,188 A * 3/1996 Deahr ..... A63H 33/00 446/123
5,816,882 A 6/1998 Guegan et al.
5,791,964 A * 8/1998 Pohlman ..... A63H 33/042 446/103
5,919,077 A * 7/1999 Gondcaille ..... A63H 17/262 446/465
6,695,667 B1 * 2/2004 Kee ..... A63H 3/003 206/457
6,913,507 B2 5/2005 Hui
6,957,996 B2 10/2005 Hui
7,059,661 B2 * 6/2006 Mataja ..... B62K 9/00 296/177
7,591,705 B2 9/2009 Ciccarelli et al.
7,614,707 B2 * 11/2009 Jabbour, Jr. ..... A63H 17/262 301/111.01

(Continued)

*Primary Examiner* — Joseph B Baldori

(57) ABSTRACT

An educational toy that is formed of parts that function as tools. For example, a toy car axle can be a screwdriver.

2 Claims, 8 Drawing Sheets

(56) References Cited

U.S. PATENT DOCUMENTS

| | | | | |
|---|---|---|---|---|
| 8,083,565 | B1 * | 12/2011 | Fulton | A63H 17/262<br>446/469 |
| 8,430,710 | B2 * | 4/2013 | Woessner | A63H 17/002<br>446/95 |
| 8,992,285 | B1 * | 3/2015 | Frantz, II | A63H 17/262<br>446/469 |
| 9,375,649 | B2 | 6/2016 | Colquhoun et al. | |
| 2002/0182974 | A1 * | 12/2002 | Grabianski | A63H 17/008<br>446/93 |
| 2005/0112987 | A1 * | 5/2005 | Chan | A63H 17/262<br>446/93 |
| 2005/0221717 | A1 * | 10/2005 | Quinn | A63H 17/002<br>446/454 |
| 2006/0205317 | A1 * | 9/2006 | Benassi | A63H 33/042<br>446/95 |
| 2007/0202773 | A1 * | 8/2007 | Yuen | A63H 17/002<br>446/94 |
| 2017/0014724 | A1 * | 1/2017 | Kwan | A63H 17/262 |

* cited by examiner

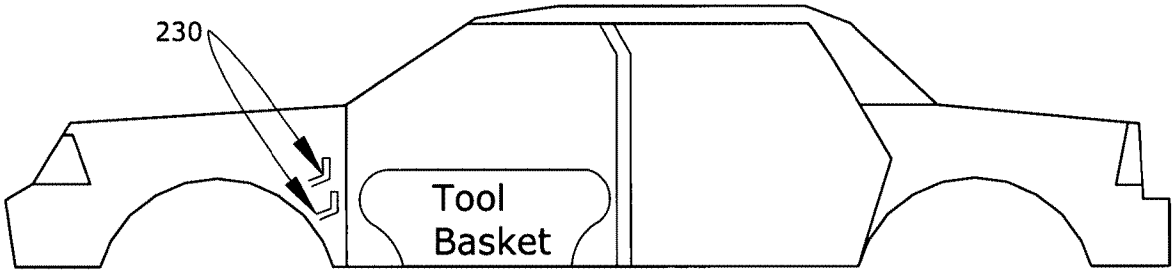
FIG. 6
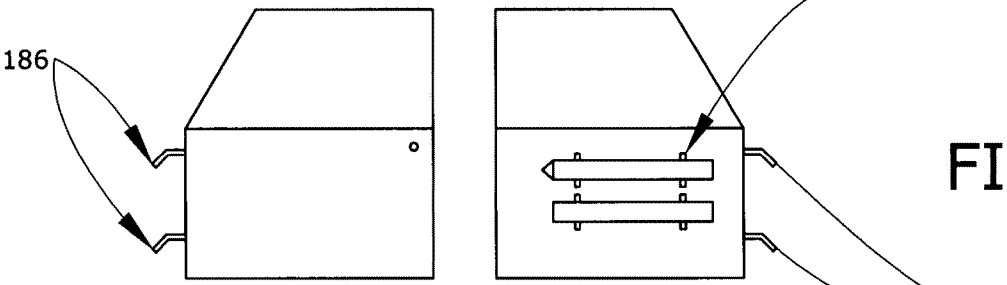
FIG. 7A
FIG. 7B
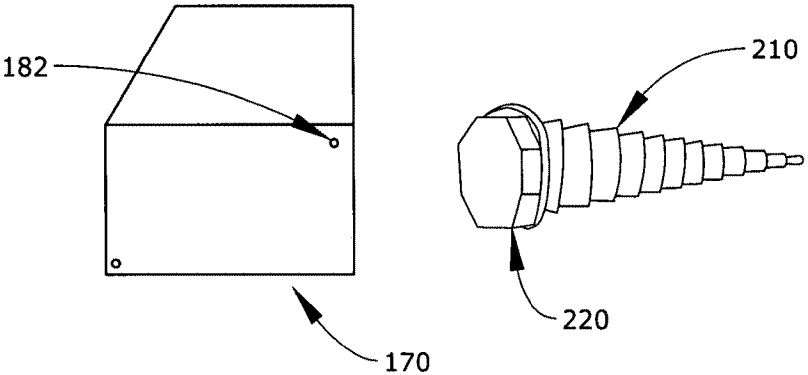
FIG. 7C
FIG. 8

TOY FORMED OF TOOLS

TECHNICAL FIELD OF THE INVENTION

The present invention relates to the general art of toys, and to the particular field of toy automobiles.

BACKGROUND OF THE INVENTION

Toy manufacturers are constantly trying to design new and improved ways to capture and maintain a child's imagination. Unfortunately for toy manufacturers, there is no formula to decide whether or not a toy will be successful. In fact, in many cases, it seems completely arbitrary why one toy is successful and another similar toy is not.

For example, although there will always be a market for traditional dolls, today's most popular dolls are dolls that cry when the child pulls a string, dolls that laugh when the child pushes their stomach, or any doll that interacts with the child. The commonality between these toys is that they all interact with the child based on the child's manual inputs. Thus, any invention which enables a toy to more actively interact with the child is a considerable improvement over the prior art.

In addition, it is equally important for toys to interact naturally. Toys on the market today do not. For example, although it is natural for a baby to cry, it is not natural for a person to cause the baby to cry by pulling a string. Thus, besides increasing a toy's ability to interact, it is also a considerable improvement over the prior art to design a toy that interacts without requiring the child to intentionally initiate the response.

Another example of a presently successful toy design is the design of transformer toys. Transformer toys are toys that allow the child to manually change the toy from one form to another, like a toy that changes from an action figure into a car or a plane. These toys have been successful because they are really two toys in one, and they allow the child's imagination to envision the toy in at least twice as many possible scenarios. For instance, an action figure limits a child's imagination to a scenario associated with an action figure, but if the action figure changes into a car, the child may imagine any scenario which involves an action figure, or a car, or any scenario including the conversion of the toy from one form to the other. Thus, any invention which creates a new way to include two toys in one is a considerable improvement over the prior art, especially, if the toy is able to transform in response to a natural or indirect triggering event.

Many toy vehicles are known which simulate actual existing vehicles such as trucks, cars, boats, planes and the like. Small children derive considerable entertainment with playing with the same. Many of these toy vehicles contain functional parts such as movable beds on dump trucks allowing them to actually contain and then dispose of a small amount of dirt, sand or the like, or pivotable cranes, rotating propellers and other movable parts.

Children in playing, utilize their imagination to augment their toys to mimic real life experiences they have been exposed to or have otherwise been educated to. The child's mind is capable of transposing his toys into a fantasy world.

Therefore, an object of this invention is to provide a new type of toy which interacts with a child.

Another object is to provide a child with a plurality of toys initially embodied in a single toy device.

Toy vehicles with at least one wheel such as cars, trucks, or motorcycles, have long been a source of entertainment for children. For example, toy vehicles have been designed for racing, performing stunts, transforming, and other creative play. The variation in themes and features spark the imagination of a child and provide continued engagement which adds to the play value.

It has been recognized by the Applicant that while the tendency of children to disassemble their toys is ordinarily destructive, this propensity can be utilized constructively to provide both education and entertainment for a child through the use of toys naturally suitable for disassembly and reassembly. Although other people have recognized the same possibility and have accordingly designed take-apart toys to achieve these goals, none of the prior art toys provides the combination of simplicity, definition of form, and versatility recognized by the Applicant as needed.

Due to the continued popularity, there remains a continuing need in the art for ever more interesting, amusing and entertaining toys.

SUMMARY OF THE INVENTION

The above-discussed disadvantages of the prior art are overcome by an educational toy that is formed of parts that function as tools. For example, a toy car axle can be a screwdriver.

The user will disassemble the small toy car/truck and use some of the parts as tools to build a larger version. For example, a smaller car, boat, plane, or train will be used to build a larger toy that will be in the same package. The parts of the car double as tools for use in building further versions, or even for other uses.

All parts of the preferred for of the toy are plastic and are used to build another toy or removed to build toys. Many of the parts of the toy snap together via prongs which fit into slots. Metal, plastic and rubber are used in the preferred form of the toy.

For example, the toy of the present invention could have a toy car door and a car window. The axle of the car can be used to assemble a larger version of the toy, which can include tires with rims and a bumper. The bumper will either screw or bolt in the front or back. A bolt or screw can be used for the rim and tire of the larger toy.

The rear axle of the preferred form will include a Phillips screwdriver which will fit into a #10¼" drive wrench, thereby making the rear axle. When disassembled, the user will be able to use the screwdriver to assemble the larger toy. The end of the drive wrench, which will accept the head of the Phillips screwdriver, will be square so that it will be used to tighten square head bolts. An additional screwdriver (a flat head screw driver), is contained in a pouch on the inside passenger side door of the car.

The front axle will be held to the car with plastic prongs, which when unsnapped and pulled apart, will become a tool that is used to build a larger car, truck, van, dump truck, or crane that can either be sold together or separately.

The preferred form of the toy car has a plastic frame with plastic prongs into which the axle snaps. The top of the toy car frame and the bottom frame bolt together. The tire rims, bumper, engine, and transmission are attached to the car via square head bolts.

The body of the car is held together with a tool that snaps to the inside door panel. The body door frame needn't be attached. It can either be bolted or screwed. Bolt holes are used to attach the body to the frame. A screwdriver will be used to put the frame to the body, which snaps in.

Other systems, methods, features, and advantages of the invention will be, or will become, apparent to one with skill in the art upon examination of the following figures and detailed description, it is intended that all such additional systems, methods, features, and advantages be included within this description, be within the scope of the invention, and be protected by the following claims.

BRIEF DESCRIPTION OF THE DRAWING FIGURES

The invention can be better understood with reference to the following drawings and description. The components in the figures are not necessarily to scale, emphasis instead being placed upon illustrating the principles of the invention. Moreover, in the figures, like referenced numerals designate corresponding parts throughout the different views.

FIG. 6 shows a frame of the vehicle.

FIG. 7A shows one door unit of the vehicle.

FIG. 7B shows a door unit of the vehicle.

FIG. 7C shows another view of the door of FIG. 7A

FIG. 8 shows a fastener and door unit of the vehicle.

DETAILED DESCRIPTION OF THE INVENTION

Figure 1:
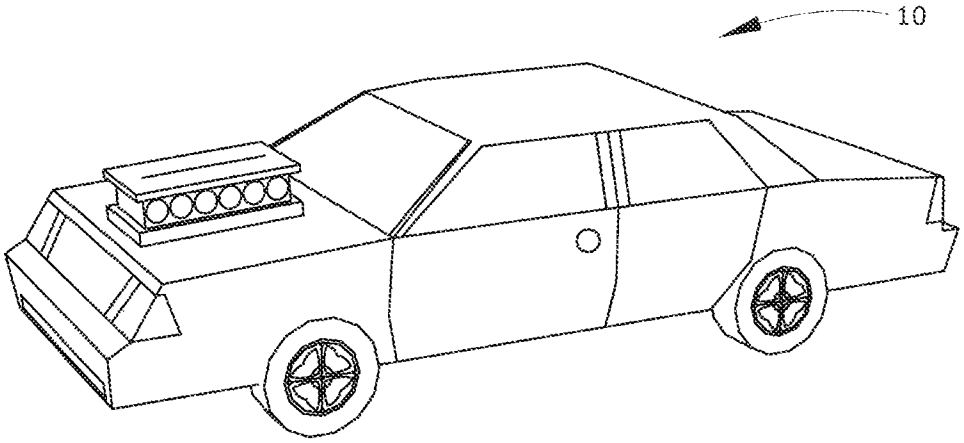
FIG. 1 shows one form of the assembled vehicle embodying the present invention.
Figure 2:
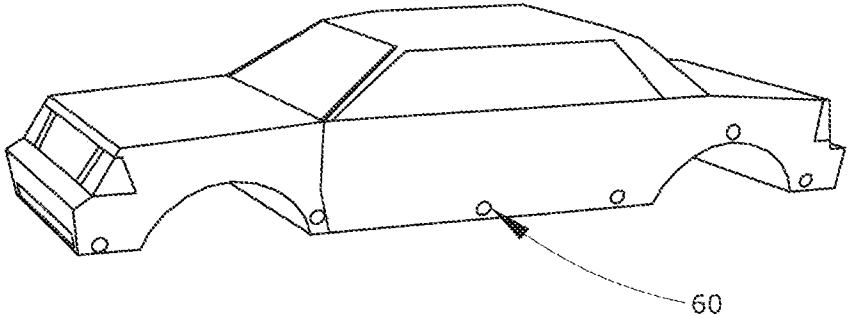
FIG. 2 shows a body frame of the vehicle embodying the present invention.
Figures 3A, 3B:
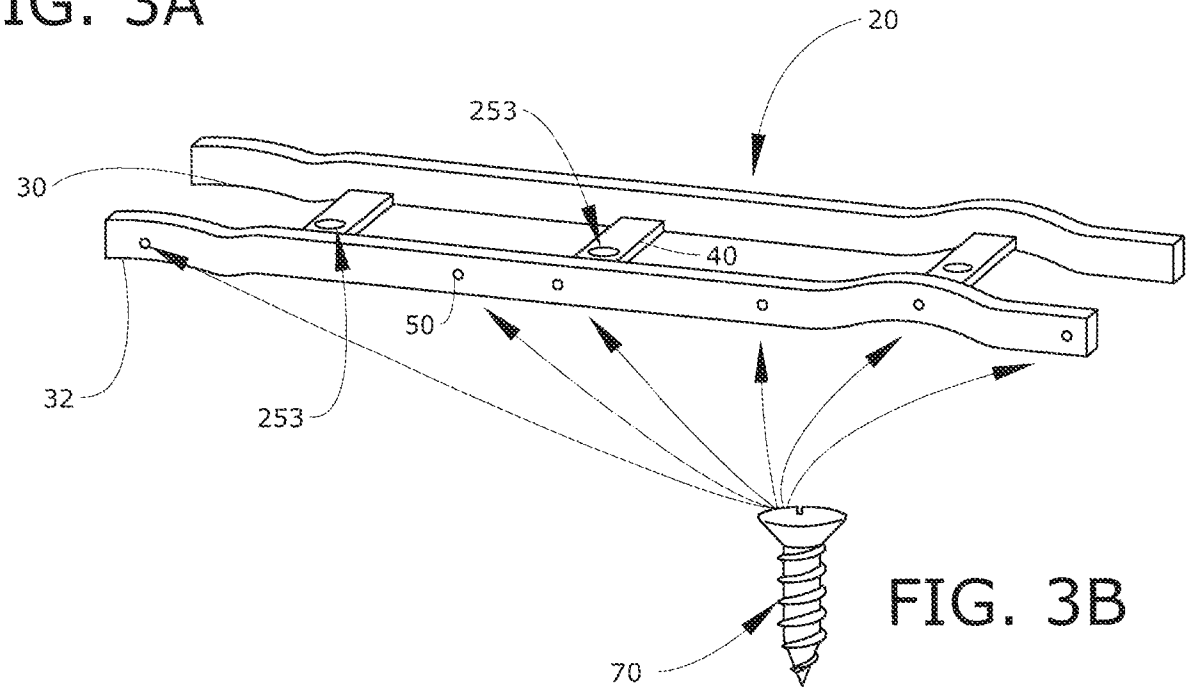
FIG. 3A shows a frame element of the vehicle.
FIG. 3B shows a fastener used in assembling the vehicle.
Figure 4:
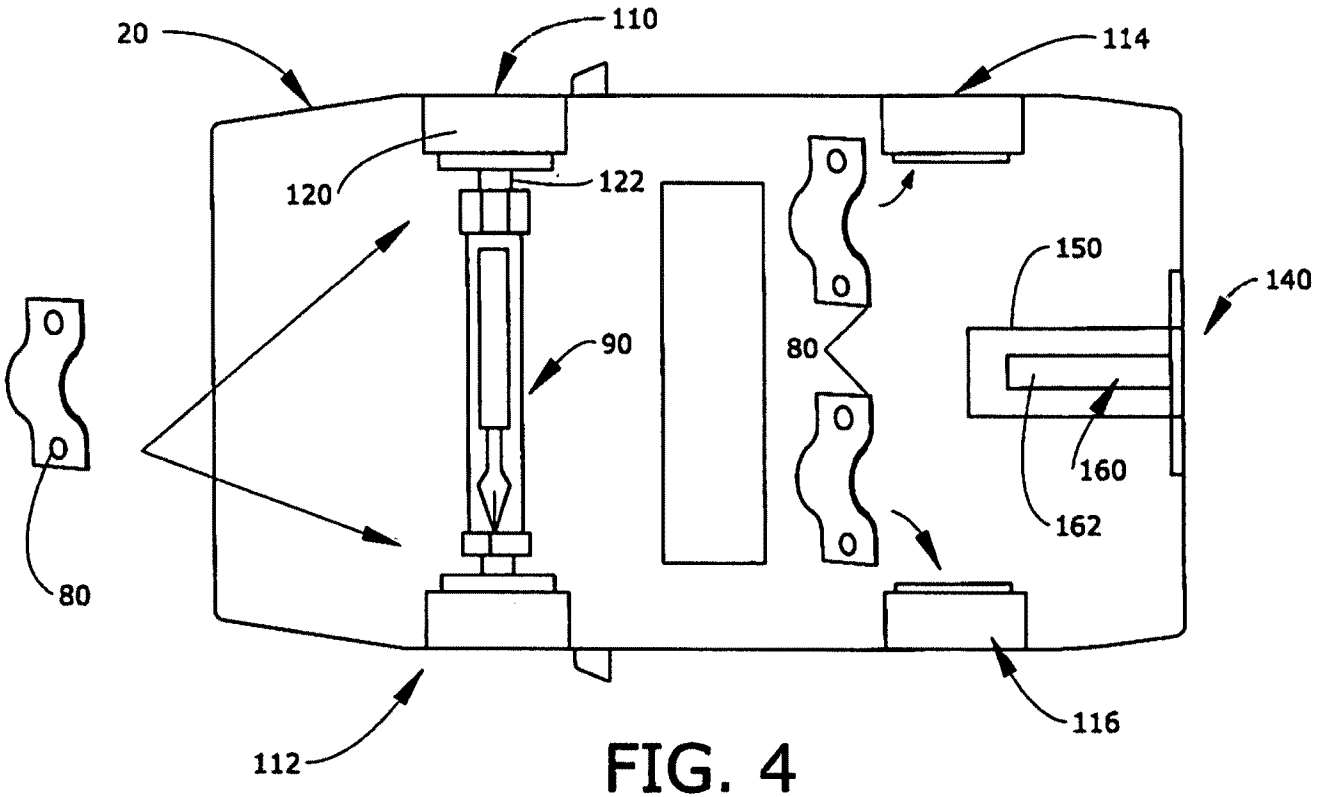
FIG. 4 is a bottom view of the vehicle.
Figure 5:
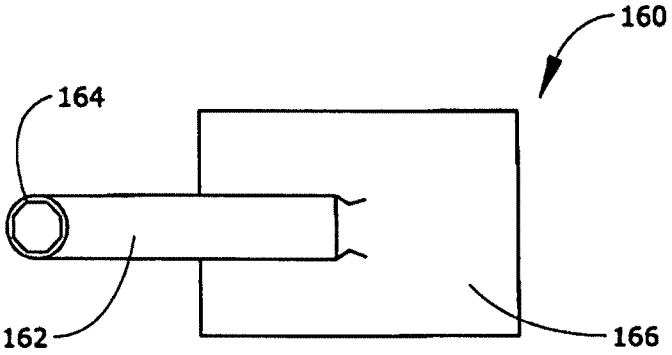
FIG. 5 shows one portion of the license plate unit of the vehicle.

Referring to the figures, it can be understood that the present invention is embodied in a knockdown compound toy vehicle 10 which comprises a chassis 20 having two side bars 30 and 32, a connecting plate 40 connecting the two side bars together, and a plurality of bolt-receiving holes, such as hole 50 defined in each side bar.

A body frame 60 is sized as a toy and can be of various sizes so various parts of the vehicle can be used to build different vehicles as will occur to those skilled in the art based on the teaching of this disclosure. A plurality of bolts, such as bolt 70, releasably connect the body frame to the chassis by means of the bolt-receiving holes. A plurality of C-shaped clips, such as clip 80, are mounted on the chassis for a purpose which will be understood from the teaching of this disclosure.

Two axle units, such as axle unit 90, are mounted on the chassis by means of the C-shaped clips. Each axle unit has a hollow tubular portion 92 having a first end 94 and a second end 96 and a screw driver element 100 having a size to be accommodated in bore 101 of hollow tubular portion, the screw driver element further having a first end 102 and a second end 104 with the second end having a phillips head screw driver element 106 thereon and being accommodated inside the hollow tubular portion during storage and being outside the hollow tubular portion during use of the screw driver element.

Figure 12:
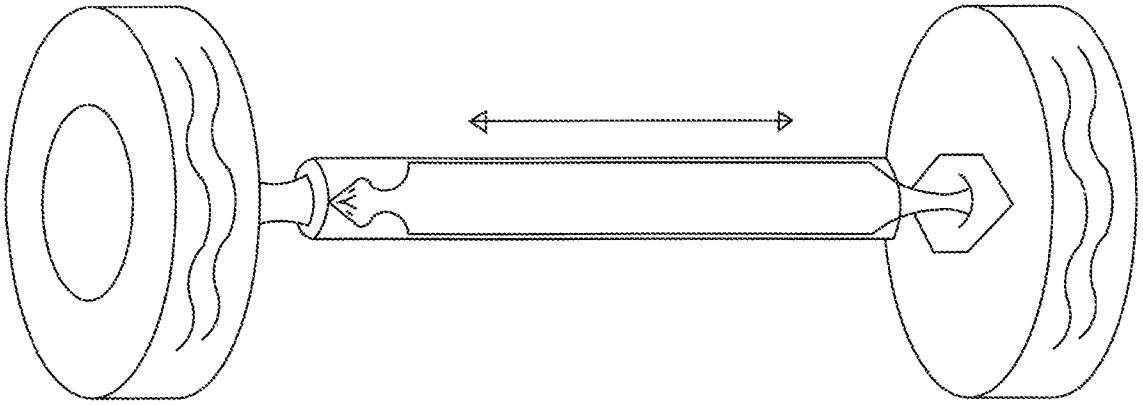
FIG. 12 shows an assembled axle unit.
Figure 14:
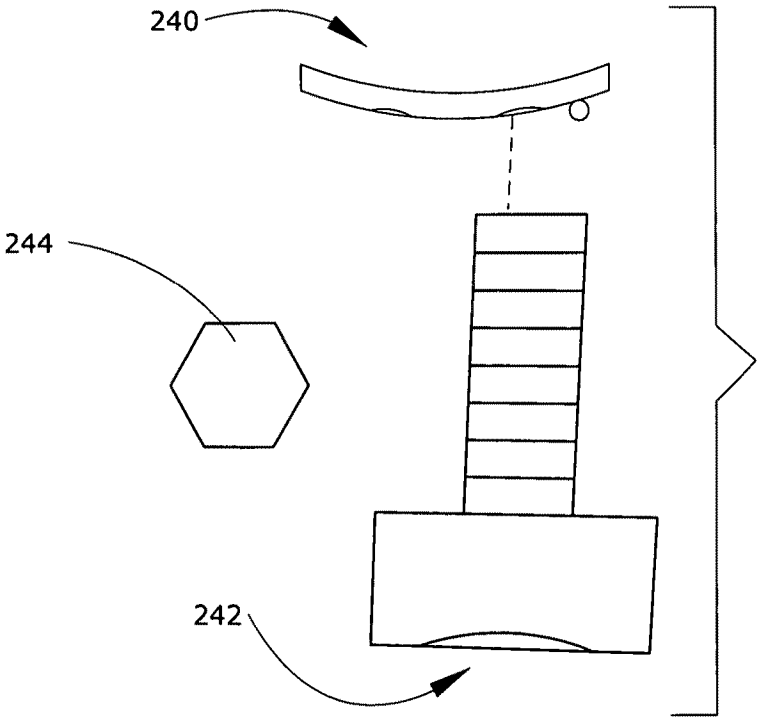
FIG. 14 shows a bolt used to affix a bumper to the frame.
Figure 13:
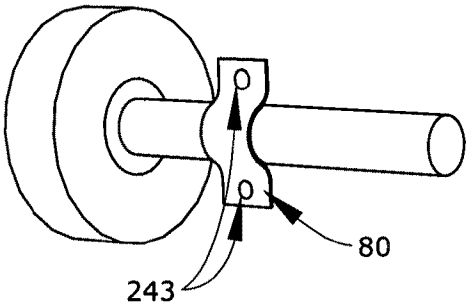
FIG. 13 shows an element attaching the axle to the chassis.

The toy vehicle further includes four wheel units 110, 112, 114 and 116. Each wheel unit has a tire element, such as tire element 120 of wheel unit 110, and a neck element, such as neck element 122 of tire element 110, mounted on the tire element. Each wheel being rotatably and releasably supported on the chassis by one of the C-shaped clips being releasably connected to the neck element of thereof. As can be understood from FIG. 12, two of the four wheel units are connected to corresponding hollow tubular portions of the axle units and two of the four wheel units are securely connected to corresponding screw driver elements of the axle units.

The vehicle further includes a license plate unit 140 releasably mounted on the body frame. License plate unit 140 includes a hollow tube 150 mounted on the body frame, and a screw driver unit 160 releasably accommodated in the hollow tube. The screw driver unit includes a body 162 which is sized to be accommodated in the hollow tube. The screw driver unit body has a socket 164 on one end and a head on another end with the socket being located inside the hollow tube when the screw driver unit is stored. The screw driver unit 160 further including a head 166 on another end of the license plate unit screw driver unit body 162 with the head of the screw driver unit body being rectangular in shape and being located outside the body frame when the screw driver unit body is accommodated in the license plate unit hollow tube.

Figure 9B:
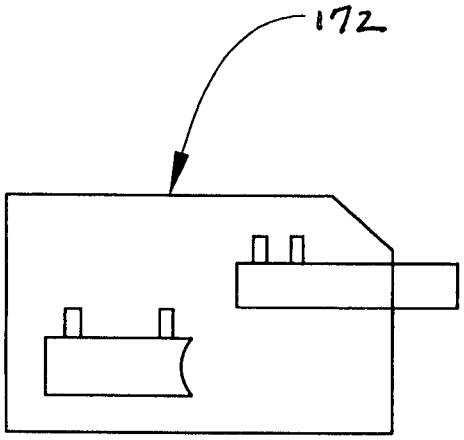
FIG. 9B shows the inside of a door unit.
Figure 9A:
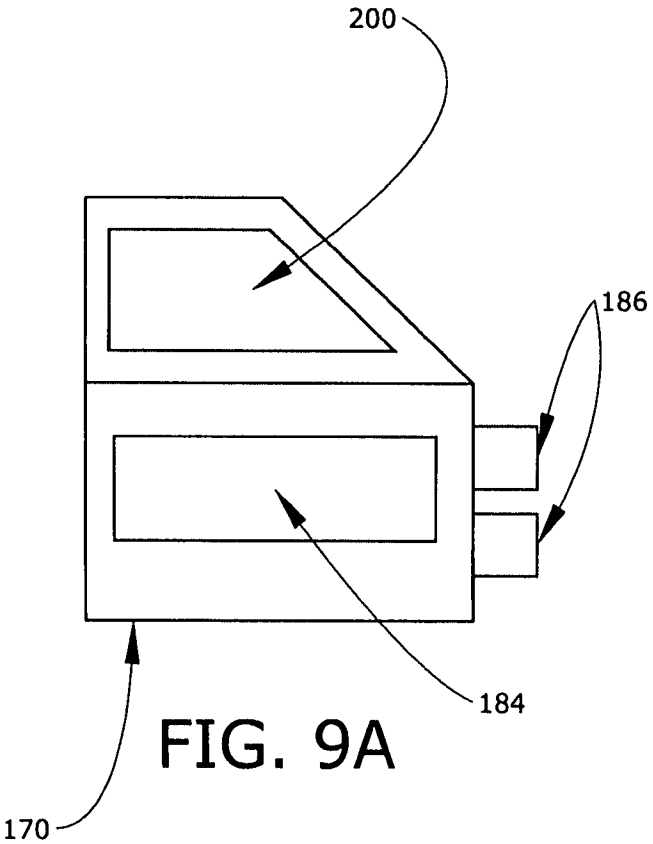
FIG. 9A shows the inside of a door unit.
Figure 10B:
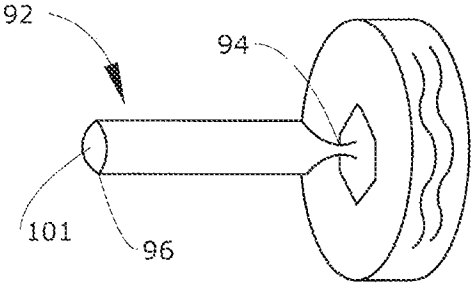
FIG. 10B shows another portion of an axle unit of the vehicle.
Figure 10A:
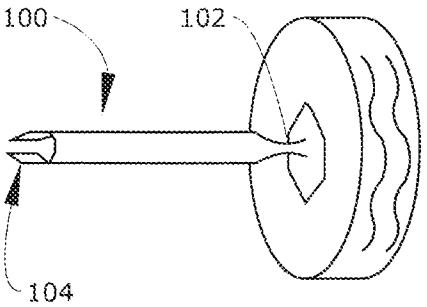
FIG. 10A shows one portion of an axle unit of the vehicle.
Figure 11:
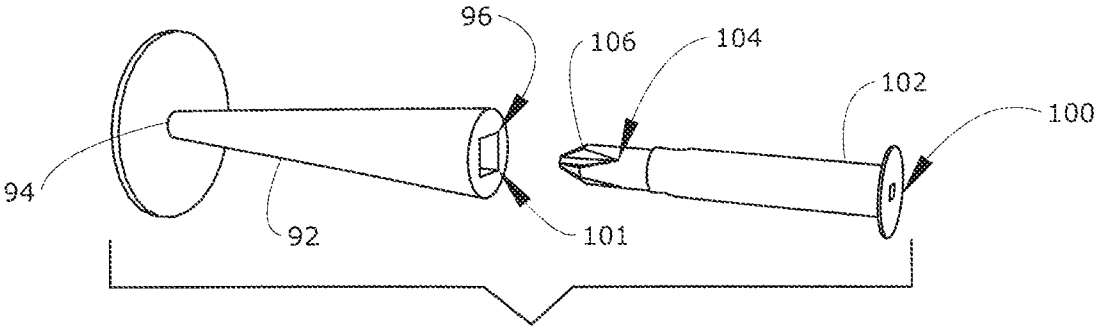
FIG. 11 shows an axle unit.

Doors 170 and 172 are mounted on body 60. Door 170 includes a plurality of fastener-receiving holes, such as hole 182, a pouch 184 (FIG. 9A), and hooks, such as hooks 186 (FIG. 7A), on one side edge thereof. Door 172 has a tool-accommodating pouch 190, and hooks 192 on one side edge thereof. Door 170 further including a window unit, such as window unit 200 (FIG. 9A).

A plurality of fasteners, such as fastener 210 (FIG. 8), releasably doors 170 and 172 on the body frame. Each fastener is accommodated in an associated fastener-receiving hole and has a head 220 which is sized and shaped to be accommodated in the socket 164 of the license plate unit screw driver unit.

A plurality of hook-accommodating elements, such as hook-accommodating elements 230 (FIG. 6), are on the body frame. Hooks 186 are releasably and pivotally accommodated in the hook-accommodating elements to releasably and pivotally mount the door units on the body frame.

A bumper element, such as element 240 can be releasably attached to the frame by bolts, such as bolt 242. Having a hexagonal head 244 so the tools, such as the screwdriver 100 or the socket 164, included with the car can be used to mount the bumper on the frame. Bolts, such as bolts 70 or 242, can be used to attach the axle unit to the chassis using fastener-accommodating holes, such as holes 243.

Figure 15:
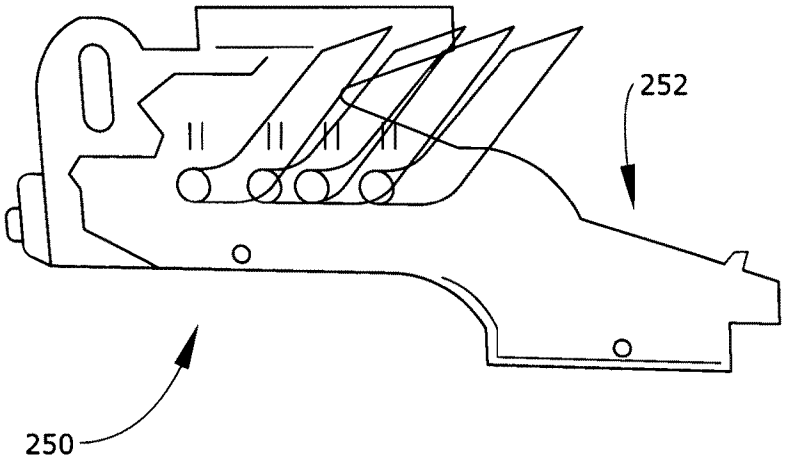
FIG. 15 shows a motor and transmission unit that is mounted on the chassis in the frame.

A motor 250 and transmission 252 (see FIG. 15) can be mounted on the chassis in the frame to complete the vehicle. Bolts, such as bolts 70 or 242, that are amenable to the tools included in the vehicle are used to mount the motor/transmission unit in the vehicle via fastener-accommodating holes, such as holes 253.

While various embodiments of the invention have been described, it will be apparent to those of ordinary skill in the art that many more embodiments and implementations are possible within the scope of this invention. Accordingly, the invention is not to be restricted except in light of the attached claims and their equivalents.

The invention claimed is:

1. A knockdown compound toy vehicle comprising:

a chassis having two side bars, a connecting plate connecting the two side bars together, and a plurality of bolt-receiving holes defined in each side bar, a body frame;

a plurality of bolts releasably connecting the body frame to the chassis by means of the bolt-receiving holes;

two axle units mounted on the chassis, each axle unit having a hollow tubular portion having a first end and a second end, and a screw driver element having a size to be accommodated in the hollow tubular portion, the screw driver element further including a first end and a second end, the second end having a phillips head screw driver element thereon and being accommodated inside the hollow tubular portion during storage and being outside the hollow tubular portion during use of the screw driver element;

a plurality of C-shaped clips mounted on each axle unit and to the chassis;

four wheel units, each wheel unit having a tire element and a neck element mounted on the tire element, each wheel unit being rotatably and releasably supported on the chassis, two of the four wheel units being connected to corresponding hollow tubular portions of each axle unit and two of the four wheel units being securely connected to corresponding screw driver elements of each axle unit;

a license plate unit releasably mounted on the body frame and including a hollow tube mounted on the body frame, and a screw driver unit releasably accommodated in the hollow tube, the screw driver unit including a body which is sized to be accommodated in the hollow tube, the screw driver unit body having a socket on one end and a head on another end with the socket being located inside the hollow tube when the screw driver unit is stored, the head of the screw driver unit body being rectangular in shape and being located outside the body frame when the screw driver unit body is accommodated in the license plate unit hollow tube;

a first door having a plurality of fastener-receiving holes, a pouch, and hooks on one side edge thereof, a second door having a pouch, and hooks on one side edge thereof, and a plurality of fasteners releasably mounting the first door on the body frame, each fastener of the plurality of fasteners being accommodated in an associated fastener-receiving hole of the first door and having a head which is sized and shaped to be accommodated in the socket of the license plate unit screw driver unit;

a plurality of hook-accommodating elements on the body frame, the hooks of the doors being releasably and pivotally accommodated on the hook-accommodating elements to releasably and pivotally mount the doors on the body frame;

a bumper element releasably mounted on the body frame;

a fastener releasably mounting the bumper element on the body frame;

a motor/transmission unit releasably mounted on the chassis in the body frame.

2. The knockdown compound toy vehicle defined in claim 1 wherein each of the first and second door further includes a window unit.

* * * * *